US005199841A

United States Patent [19]

Von Gehlen

[11] Patent Number: 5,199,841

[45] Date of Patent: Apr. 6, 1993

[54] APPARATUS FOR CUTTING OPEN A FIBER BALE STRAP

[75] Inventor: Walter Von Gehlen, Mönchengladbach, Fed. Rep. of Germany

[73] Assignee: Trützschler GmbH & Co. KG, Mönchengladbach, Fed. Rep. of Germany

[21] Appl. No.: 625,454

[22] Filed: Dec. 11, 1990

[30] Foreign Application Priority Data

Dec. 19, 1989 [DE] Fed. Rep. of Germany ..... 3941856

[51] Int. Cl.[5] ..... B65B 69/00

[52] U.S. Cl. ..... 414/412; 83/909

[58] Field of Search ..... 414/412; 83/676, 935, 83/909, 924, 425.3

[56] References Cited

U.S. PATENT DOCUMENTS

| | | | |
|---|---|---|---|
| 2,875,828 | 3/1959 | Fleming | 83/676 X |
| 3,055,045 | 9/1962 | Brendle et al. | 83/676 X |
| 3,152,501 | 10/1964 | Nassar | 83/676 X |
| 3,664,530 | 5/1972 | Takiguchi | 414/412 |
| 3,682,027 | 8/1972 | Insolio et al. | 83/676 X |
| 3,777,607 | 12/1973 | Schofield | 83/676 X |
| 3,832,927 | 9/1974 | Warnock et al. | 83/425.3 X |
| 3,974,727 | 8/1976 | Stehlin | 83/676 X |
| 4,370,910 | 2/1983 | Suzuki et al. | 83/676 X |
| 4,436,006 | 3/1984 | Nakamura et al. | 83/676 X |
| 4,555,312 | 11/1985 | Mitzel et al. | 83/909 X |
| 4,779,498 | 10/1988 | Perkins | 83/924 X |
| 4,835,836 | 6/1989 | van Uitert | 83/909 X |
| 4,929,141 | 5/1990 | Keesey et al. | 83/909 X |
| 4,976,583 | 12/1990 | Moltrasio | 414/412 X |

FOREIGN PATENT DOCUMENTS

| | | | |
|---|---|---|---|
| 0117036 | 8/1984 | European Pat. Off. . | |
| 0267138 | 5/1988 | European Pat. Off. . | |
| 1221150 | 7/1966 | Fed. Rep. of Germany | 414/412 |
| 1249770 | 9/1969 | Fed. Rep. of Germany . | |
| 2029511 | 2/1974 | Fed. Rep. of Germany . | |
| 2453542 | 5/1976 | Fed. Rep. of Germany . | |
| 3229765 | 2/1984 | Fed. Rep. of Germany | 414/412 |
| 3504768 | 8/1985 | Fed. Rep. of Germany . | |
| 45238 | 2/1989 | Japan | 414/412 |
| 1312006 | 5/1987 | U.S.S.R. | 414/412 |
| 1366446 | 1/1988 | U.S.S.R. | 414/412 |
| 1139065 | 1/1969 | United Kingdom . | |
| 1335233 | 10/1973 | United Kingdom . | |
| 1505684 | 3/1978 | United Kingdom . | |
| 2138769 | 10/1984 | United Kingdom | 414/412 |

OTHER PUBLICATIONS

IBM Technical Disclosure Bulletin, vol. 17, No. 4, Sep. 1974, pp. 1157–1158, Block E. E., "Cutting Mechanism for Endless Belts".

*Primary Examiner*—David A. Bucci

*Attorney, Agent, or Firm*—Spencer, Frank & Schneider

[57] ABSTRACT

An apparatus for severing a strap surrounding a fiber bale includes a cutting disk having a periphery and a cutting edge on the periphery; a support for rotatably supporting the cutting disk; and a displacing arrangement for effecting relative movement under mutual pressure between the fiber bale and the cutting disk for moving the cutting disk in the fiber bale toward the strap and for severing the strap in a direction generally perpendicular to the strap length.

17 Claims, 3 Drawing Sheets

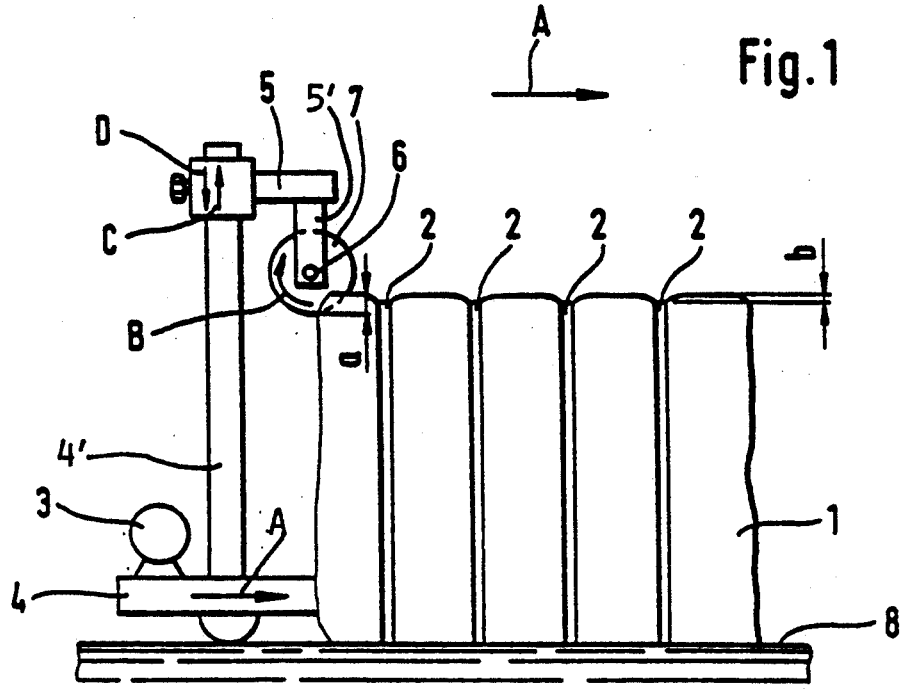
Fig.1
Fig.2
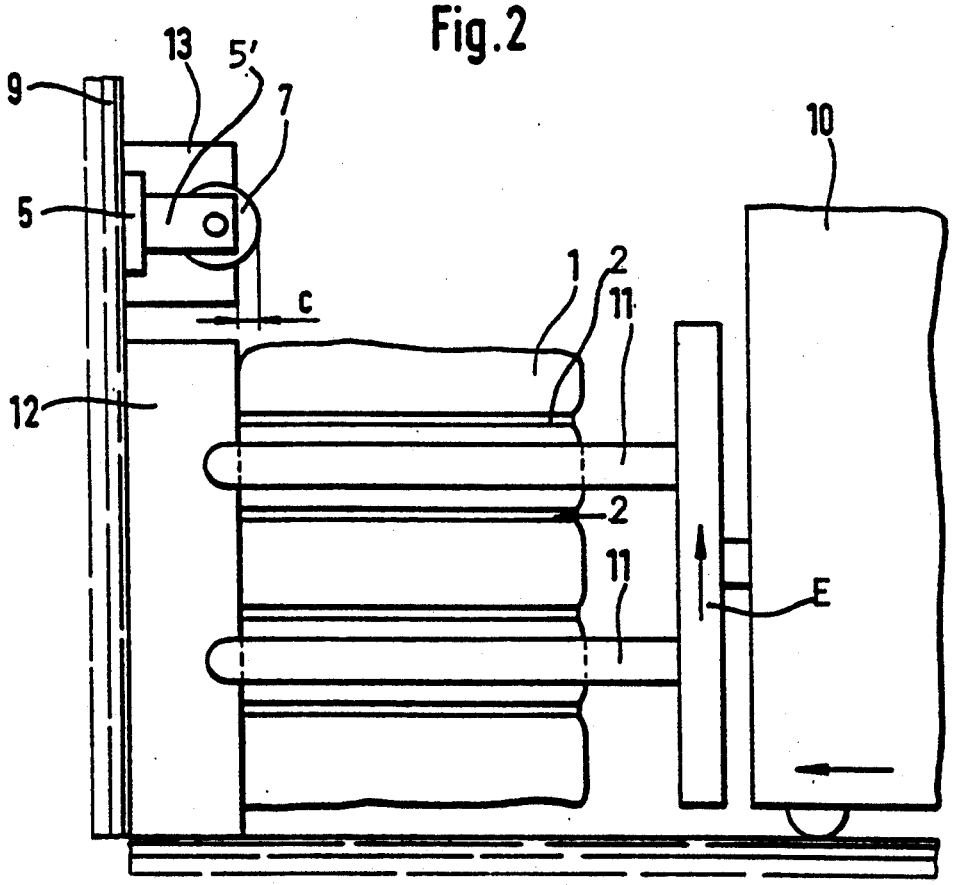

APPARATUS FOR CUTTING OPEN A FIBER BALE STRAP

BACKGROUND OF THE INVENTION

This invention relates to an apparatus for cutting open a strap which holds together a textile fiber bale. The apparatus includes a cutting edge which severs the strap essentially in a direction which is perpendicular to the strap length.

Bale straps have been cut for many decades by a hatchet or similar tool. In a known device severance of the strap is achieved by means of a single, high velocity impact directed to a single strap. In such a device where the cutting tool has a narrow cutting edge, complex arrangements, for example, a special pneumatic cylinder, have been necessary to produce the impact. It is a further disadvantage of the prior art cutters of this type that first the exact position of the individual straps has to be separately determined and then the narrow cutter has to be brought step-wise into position at the straps, based on the preceding positional determination.

SUMMARY OF THE INVENTION

It is an object of the invention to provide an improved device of the above-outlined type from which the discussed disadvantages are eliminated and which is of simple construction and is capable of severing bale straps without previous determination of the strap positions.

This object and others to become apparent as the specification progresses, are accomplished by the invention, according to which, briefly stated, the cutting edge is formed on the circumference of a rotatable cutting disk and a device is provided by means of which the cutter disk and/or fiber bale may be moved relative to one another under the application of a pressure force which urges the cutting disk and the fiber bale towards one another.

Thus, according to the invention, the cutting disk is urged under pressure into the strapped fiber bale to a depth of, for example, 50 mm, and thereafter the cutting disk is advanced in the direction of the bale strap or bale wire to effect severance of the strap or wire. The physical or mechanical reasons of the severing phenomenon according to the invention have not yet been entirely clarified. Under the effect of pressure as the cutting tool slowly progresses, the strap is first nicked and thus locally weakened. As the circular cutting disk continues to advance, and increasing pressure is exerted on the strap, the latter expands and ruptures at the cutting location. In this manner, there is achieved, in a structurally particularly simple and surprising manner, a severance of the straps surrounding the textile fiber bales, without the need of imparting an impactlike stress on the cutter.

BRIEF DESCRIPTION OF THE DRAWINGS

FIG. 1 is a schematic side elevational view of a preferred embodiment of the invention.

FIG. 2 is a schematic side elevational view of a another preferred embodiment of the invention.

DESCRIPTION OF THE PREFERRED EMBODIMENTS

Figure 3:
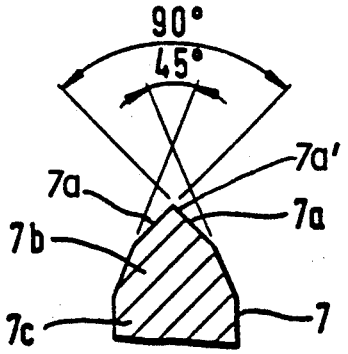
FIG. 3 is a sectional view of a cutter component forming part of the embodiments illustrated in FIGS. 1 and 2.

Turning to FIG. 1 there is illustrated therein a textile fiber bale 1 secured by a plurality of spaced straps, for example steel bands 2. The fiber bale is stationarily supported on a floor 8. A carriage 4, drivable in the direction A by a motor 3 has a column 4' on which there is vertically adjustably secured a support 5 carrying downwardly extending yoke 5'. A cutting disk 7 of full circular construction is held in the yoke 5' by means of a shaft 6. In operation, the cutting disk 7 is, as the carriage 4 travels in the direction A, driven, for example at a speed of 0.75 m/min into the fiber bale 1 at a depth a of, for example, 50 mm. The cutting disk 7 rotates in the direction B as it is driven by frictional engagement with the fiber bale; thus, the cutting disk 7 does not need a separate drive. The carriage 4 is driven slowly towards the straps 2 and exerts a pressure on the fiber bale as the fiber bale and the cutting disk 7 move relative to one another. During its travel through the fiber bale, the cutting disk 7 cuts through the straps 2 which are significantly tensioned and thus penetrate into the fiber material to a depth b.

Turning to FIG. 2, the support 5, the bracket 5' and the cutting disk 7 are mounted on a vertical wall 9. The fiber bale 1 is supported on a carriage 10, such as a fork lift and is held by bars, such as forks 11. Between the wall 9 and the fiber bale 1, there is provided a spacer 12 against which a vertical surface of the fiber bale 1 abuts. The cutting disk 7 projects beyond the abutment face of the spacer 12 by a distance c. The support 5 and a greater part of the cutting disk 7 are covered by a housing 13. The cutting operation is effected by raising the fork lift in the direction of the arrow E. Similarly to the embodiment described in connection with FIG. 1, a pressure is exerted by the cutting disk 7 on the fiber bale 1 as these two components move relatively to one another as the fiber bale is lifted by the fork lift and the cutting disk 7 travels towards the straps 2 at a depth c.

FIG. 3 illustrates the peripheral portion of the cutting disk 7 in section. The tempered cutting faces 7*a* which converge and terminate in a cutting edge 7*a'* are arranged at an angle of between 60° and 90° to one another. Between the cutting faces 7*a* and the base body 7*c* of the cutting disk 7 there is provided an intermediate portion 7*b* which has external side faces oriented at an angle of 45° to one another.

Figure 4:
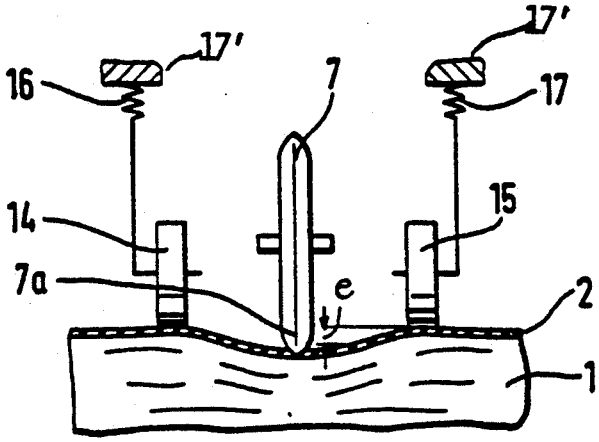
FIG. 4 is a schematic front elevational view of a part of still another preferred embodiment of the invention.

Turning now to the embodiment illustrated in FIG. 4, on either side of the cutting disk 7 there are provided two pressure rollers 14 and 15 which, as the cutting disk 7 performs its severing function, press down on the strap 2 against the fiber bale 1. This arrangement is particularly advantageous in case of a soft fiber material or relatively loose (low pressure) fiber bale. The pressure rollers 14 and 15 are supported on a carrier member 17' with the intermediatry of pressure springs 16 and 17. The cutting disk 7 presses deeper into the bale 1 and the strap 2 than the pressure rollers 14 and 15; that is, the cutting disk 7 projects beyond the periphery of the rollers 14, 15 by a distance e.

Figure 5:
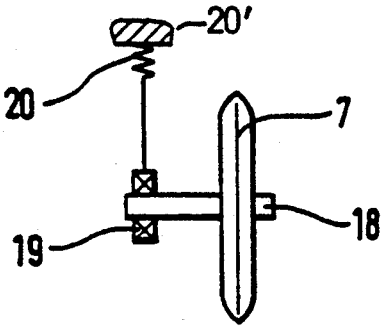
FIG. 5 is a schematic front elevational view of a cutter component of any of the preferred embodiments.

In FIG. 5, the cutting disk 7 has a shaft 18 which is supported in a bearing 19, which, in turn, is mounted on a carrier 20' with an intermediary of a pressure spring 20.

Figure 6:
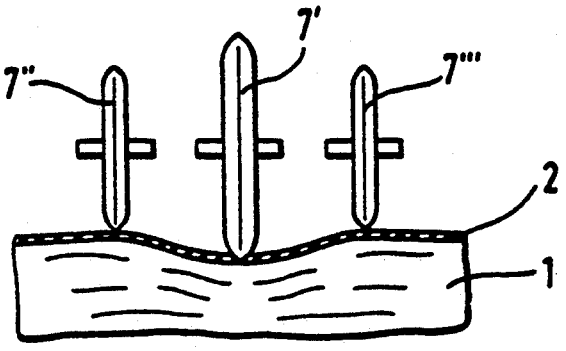
FIG. 6 is a schematic front elevational view of a part of still another preferred embodiment of the invention.

Turning to FIG. 6, there are shown a plurality of coaxially arranged, parallel-oriented cutting disks 7', 7'' and 7'''. The diameter of the central cutting disk 7' is greater than that of the two flanking cutting disks 7'' and 7'''.

Figure 7:
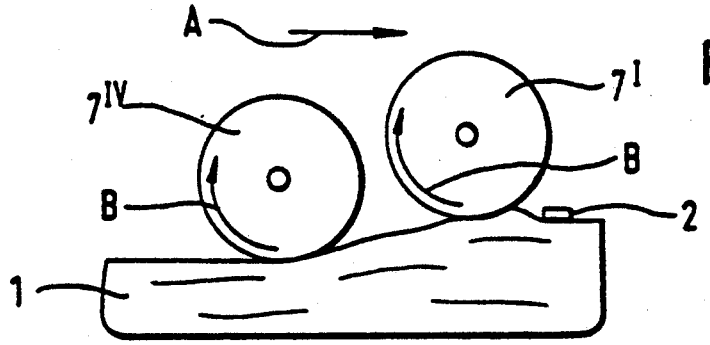
FIG. 7 is a schematic side elevational view of a part of still a further preferred embodiment of the invention.

In FIG. 7, two cutting disks $7^{I}$ and $7^{IV}$ are provided in series as viewed in the working direction A. The trailing cutting disk $7^{IV}$ penetrates deeper into the fiber bale than the leading cutting disk $7^{I}$. Such an arrangement takes into account fiber bales of different pressure which thus constitute a different countersupport for the straps 2.

Figure 8:
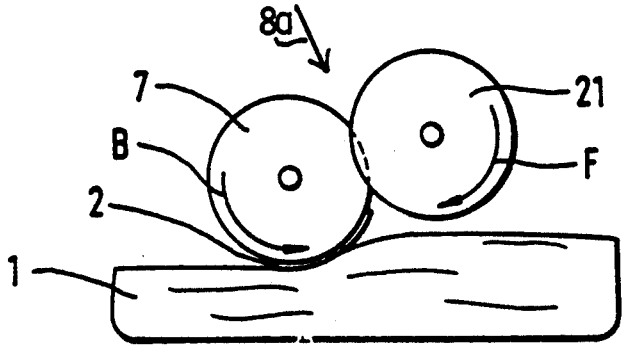
FIG. 8 is a schematic side elevational view of yet another preferred embodiment of the invention.
Figure 8A:
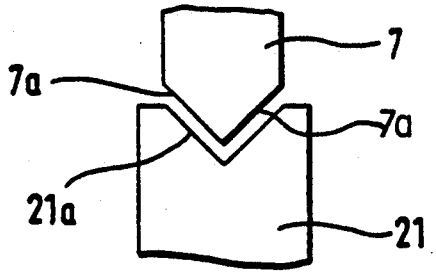
FIG. 8*a* is a fragmentary view as seen in the direction of arrow 8*a* of FIG. 8.

In the embodiment shown in FIG. 8, the cutting disk 7 rotating in the direction B cooperates with a counter disk 21 which rotates in an opposite direction, as indicated by the arrow F. The cutting disk 7 and the counter disk 21 are driven by a non-illustrated motor. As illustrated in FIG. 8*a*, the counter disk 21 has a peripheral groove 21*a* which receives the cutting faces 7*a* of the cutting disk 7, whereby the two disks 7 and 21 are in an overlapping relationship. Further, the cutting disk 7 and the counter disk 21 are at different height levels. In operation, the strap 2 is pressed by the cutting disk 7 into the gap defined by the disks 7 and 21 and is thus sheared by a rotary scissors effect.

Figure 9:
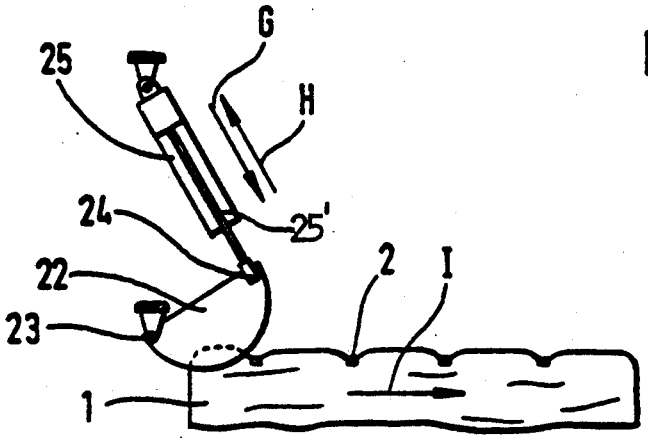
FIG. 9 is a schematic side elevational view of yet another preferred of the invention.

FIG. 9 illustrated an embodiment in which the cutting disk 22 has the shape of a circular segment, such as a half circle and is rotatable about an eccentric location 23 situated in a corner zone of the disk 22. A hydraulic pressure cylinder unit 25 is in engagement with the cutting disk 22 at another corner zone 24 spaced from the location 23. The piston rod 25' of the hydraulic cylinder unit 25 is displaceable in the direction of the arrows G and H. The fiber bale 1 is moved in the direction of the arrow I underneath the cutting disk 22, for example, by means of a bale supporting stand at a speed of 0.75 m/min. In operation, by means of the periodic rocking motions of the disk 22 pressure is exerted on the straps 2, thus causing severance thereof.

It will be understood that the above description of the present invention is susceptible to various modifications, changes and adaptations, and the same are intended to be comprehended within the meaning and range of equivalents of the appended claims.

What is claimed is:

1. Apparatus for severing a strap surrounding a fiber bale, comprising (a) a non-driven, idling cutting disk rotatable at least 360 degrees and having a periphery and a cutting edge on said periphery;

(b) support means for rotatably supporting the cutting disk; and (c) displacing means for effecting relative movement under mutual pressure between the fiber bale and the cutting disk for moving and rotating said cutting disk in said fiber bale toward said strap and for severing said strap in a direction generally perpendicular to a length dimension of said strap.

2. An apparatus as defined in claim 1, wherein said cutting disk is fully circular.

3. An apparatus as defined in claim 1, wherein said displacing means comprises a carriage on which said cutting disk is mounted and motor means for propelling said carriage.

4. An apparatus as defined in claim 1, further comprising spring means for biasing said cutting disk.

5. An apparatus as defined in claim 1, wherein said cutting edge is defined by two intersecting cutting faces converging at an angle of approximately 60°-90°.

6. An apparatus as defined in claim 1, wherein said cutting disk is a first cutting disk; further comprising a second cutting disk having a periphery and a cutting edge provided on the periphery of the second cutting disk; said first and second cutting disks being spaced from one another in a direction parallel to said relative movement and being arranged for penetrating into the fiber bale to different depths.

7. An apparatus as defined in claim 1, further comprising bale pressing means arranged on either side of said cutting disk for pressing the strap against the fiber bale.

8. An apparatus as defined in claim 7, wherein said bale pressing means comprises pressure rollers.

9. An apparatus as defined in claim 7, wherein said bale pressing means comprises springs exerting a pressing force.

10. An apparatus as defined in claim 8, wherein said cutting disk has a diameter greater than diameters of said pressure rollers.

11. An apparatus as defined in claim 1, wherein said displacing means comprises a carriage on which said fiber bale is supported.

12. An apparatus as defined in claim 11, further comprising means for stationarily affixing said cutting disk.

13. An apparatus as defined in claim 1, wherein said cutting disk is a first cutting disk; further comprising a second cutting disk having a periphery and a cutting edge on said periphery of said second cutting disk; said first and second cutting disk being oriented in a side-by-side, parallel, spaced arrangement relative to one another.

14. An apparatus as defined in claim 13, further comprising a third cutting disk having a periphery and a cutting edge on said periphery of said third cutting disk; said first cutting disk being flanked by said second and third cutting disks and having a diameter smaller than diameters of said second and third cutting disks.

15. An apparatus as defined in claim 1, further comprising a counter disk arranged for cooperating with said cutting disk to form rotary scissors therewith.

16. An apparatus as defined in claim 15, further comprising means for rotating at least one of said disks.

17. An apparatus as defined in claim 15, wherein said counter disk has a peripheral groove receiving the cutting edge of said cutting disk, whereby said cutting disk and said counter disk are in an overlapping relationship with one another.

* * * * *